US006810126B2

(12) United States Patent
Levitsky

(10) Patent No.: US 6,810,126 B2
(45) Date of Patent: Oct. 26, 2004

(54) PLANAR MAGNETIC TRANSDUCER

(75) Inventor: Igor Levitsky, Toronto (CA)

(73) Assignee: BG Corporation, Carson City, NV (US)

( * ) Notice: Subject to any disclaimer, the term of this patent is extended or adjusted under 35 U.S.C. 154(b) by 358 days.

(21) Appl. No.: 10/001,916

(22) Filed: Oct. 24, 2001

(65) Prior Publication Data

US 2003/0076977 A1 Apr. 24, 2003

(51) Int. Cl.[7] ..... A04R 28/00

(52) U.S. Cl. ..... 381/191; 381/413; 381/431; 381/398; 381/399; 381/423; 381/402; 181/157

(58) Field of Search ..... 381/191, 184, 381/395, 398, 399, 402, 423, 431, 408, 413, 426; 181/157, 167, 170

(56) References Cited

U.S. PATENT DOCUMENTS 4,395,592 A * 7/1983 Calangelo
4,468,530 A * 8/1984 Torgeson
4,480,155 A * 10/1984 Winey
4,803,733 A * 2/1989 Carver
5,003,610 A * 3/1991 Adachi
5,021,613 A * 6/1991 Garcia

* cited by examiner

*Primary Examiner*—Curtis Kuntz
*Assistant Examiner*—Dionne N. Harvey
(74) *Attorney, Agent, or Firm*—W. Edward Johansen

(57) ABSTRACT

A panel transducer includes a diaphragm with areas of multiple electrical conductors, two rows of magnetic bars, two metal plates and a clamping frame. The diaphragm is clamped in the clamping frame and is positioned between the two rows of magnetic bars. Each row of magnetic plates is in close proximity to the clamped diaphragm. Each metal plate has holes. The holes correspond to spacing areas between the magnetic bars and acoustically connect the diaphragm to outside media. The magnetic bars are sequentially located on the metal plates with spacing between the magnetic bars. The diaphragm is secured to the clamping frame and has an active surface area under tension spaced inwardly of the clamping frame. There are no side magnetic bars at the ends of each of the row. Absorbing strips are used in place of the absent magnetic bars filling the space between the side magnetic bars and the clamping frame.

1 Claim, 2 Drawing Sheets

Fig. 1. (PRIOR ART)
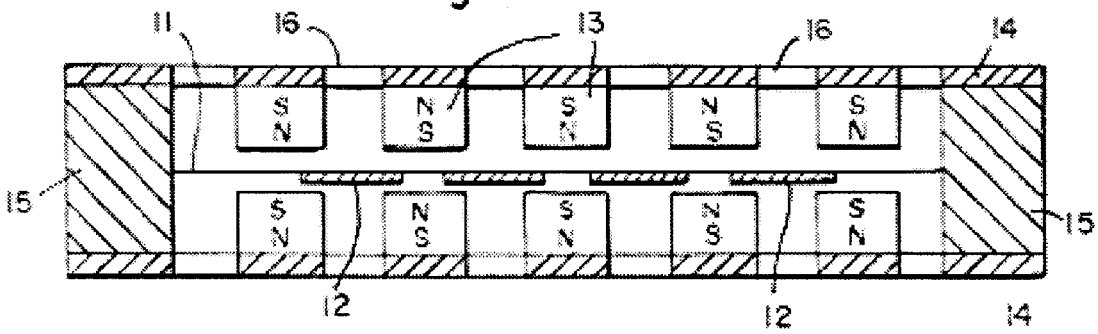
Fig. 2. (PRIOR ART)
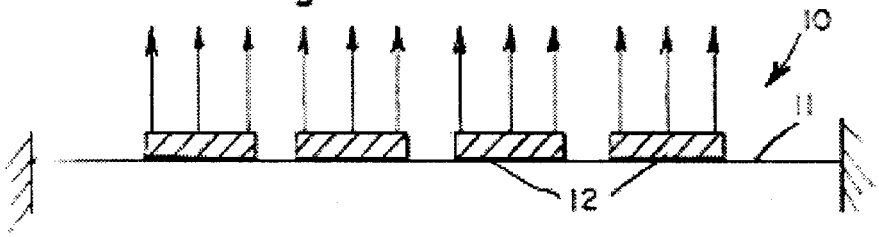
Fig. 3. (PRIOR ART)
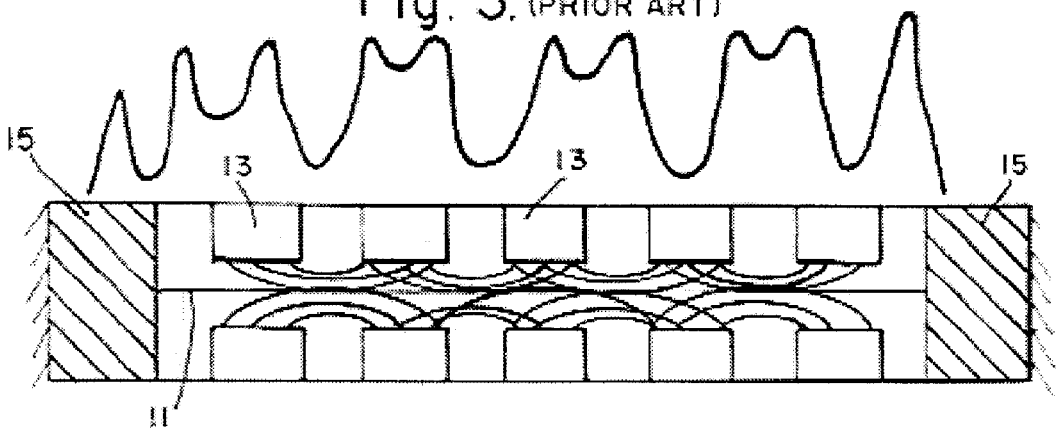
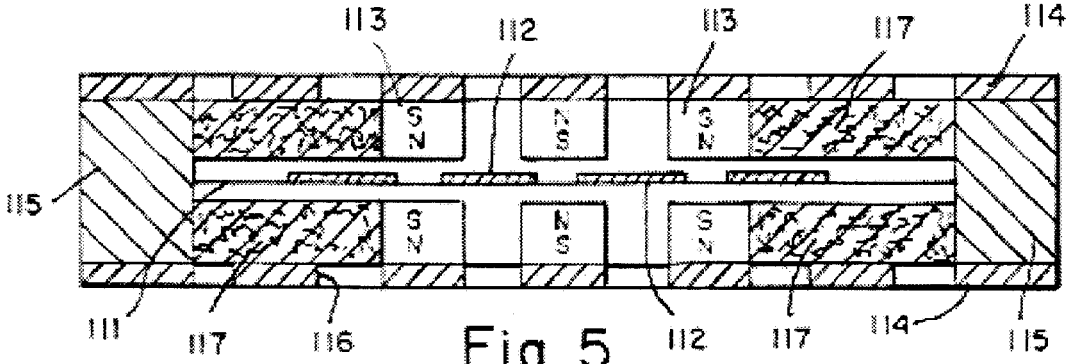
Fig. 5.

Fig. 6.
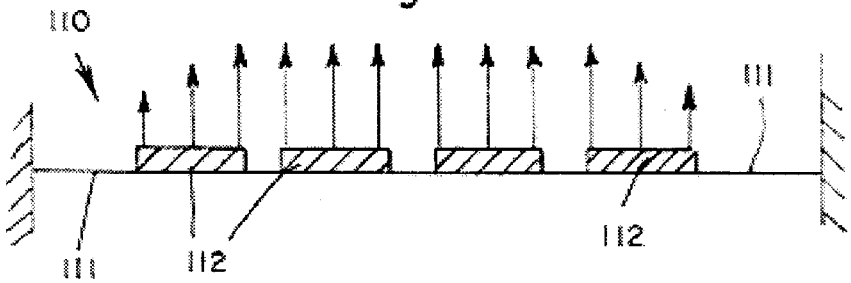
Fig. 7.
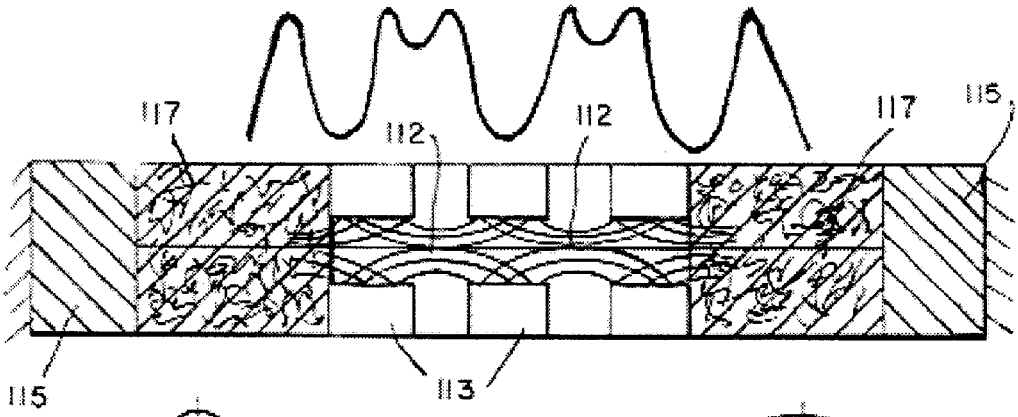
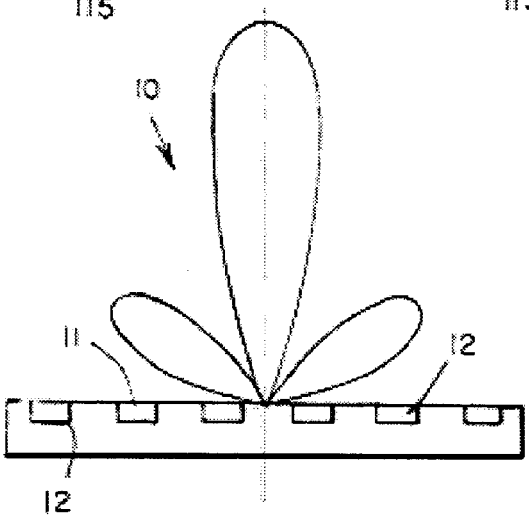
Fig. 4.
(PRIOR ART)
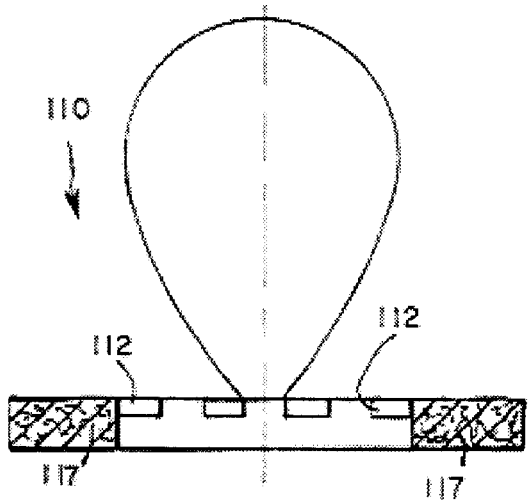
Fig. 8.

PLANAR MAGNETIC TRANSDUCER

BACKGROUND OF THE INVENTION

U.S. Pat. No. 3,013,905 teaches a transducer which includes a magnet plate and a membrane. The magnetic plate is made from highly coercive oriented ferrite material, e.g. the barium ferrite commercially known as "Indox V" of a high coercive force. The high coercive force is of the order of 2000 oersteds. It is magnetized in such a manner that alternating north poles and south poles extend in parallel over the entire length of the magnetic plate. Between each of two vicinal poles the flux runs through the depth of the magnetic plate. The flux can be conceived as a horseshoe magnet. The membrane is a pliable sheet of non-magnetic material, such as a polyester plastic material, of a thickness of about 0.01 millimeter. On it, a conductor of a material, such as aluminum, is printed in the form of a very thin, flat band. The thin, flat band is pliable and has a very low mechanical impedance. The membrane is substantially coextensive with the magnetic plate, tautly stretched above the plate at a distance of about 2.0 millimeters or less and secured at its edges in any suitable conventional manner. The conductor is continuous and runs in parallel stretches from end to end of the membrane, returning at the ends in short arcs. The stretches are in registry with the magnetic gaps between consecutive opposite poles of the magnetic plate with the gap between the poles of the magnet and the stretch with the gap between the poles of magnet. The expression of magnetic gaps does not imply a conventional air gap as the magnetic plate has a stretch that is a continuous plane surface. At its ends the conductor has two or more terminals for connection to the input or output circuit, as the case may be. The magnetic plate has a plurality of holes, for the equalization of the air pressure in the gap between the magnet plate and membrane. When an electric current flows in the conductor, its direction is reversed from stretch to stretch of the conductor. Each change of direction corresponds to a change of direction of the magnetic field or, in other words, the vector product of the current with the magnetic field has the same sign in all parts of the conductor. The membrane thus oscillates in phase over its entire surface with the frequency of the alternating current passing through the conductor. The magnetic plate is built up from discrete bars mounted in parallel on a soft-iron, perforated armature plate 4a with equal gaps between them. Their top faces form alternately north and south poles.

U.S. Pat. No. 4,484,037 teaches a ribbon-type electro-acoustic transducer which has a magnetic system. The magnetic system includes an upper plate and a center pole between which an air gap is formed. A diaphragm on which conductors are arranged is disposed in the air gap. The upper plate includes two plate-shaped parts between which a space is formed in which an edge portion of the diaphragm is located. This results in a more homogeneous magnetic field so that the transducer distortion may be reduced. Moreover, the transducer sensitivity is improved and is suitable for handling signals in the mid-range audio frequency spectrum. The cavity enclosed by the magnet system and the diaphragm can be acoustically coupled, be via an additional cavity to a bass-reflex duct or an additional passive radiator diaphragm.

U.S. Pat. No. 5,850,461 teaches a diaphragm mounting system for flat acoustic planar magnetic and electrostatic transducers. The system incorporates opposing frame sections. Each frame section defines a clamping or peripheral surface area and an internal or central area through which acoustic waves may pass from the diaphragm. The diaphragm is first placed on one frame section with zero plus tension. The second frame section includes a protruding ridge extending substantially along an inner edge of the central area which ridge defines a border for a sound producing area of the diaphragm. During assembly of the two frame sections, the ridge engages the diaphragm to place predetermined tension on the diaphragm as the sections are joined. The profile of the ridge may be shaped to provide predetermined biaxial tension in a diaphragm of generally rectangular shape.

U.S. Pat. No. 4,471,172 teaches a planar diaphragm type magnetic transducer with magnetic circuit in which the magnet strips on the soft iron plate and confronting the diaphragm are arranged in a sequence south, north, north, south, south, north, north, south, et seq. The magnet strips are spaced across the transducer and the metal plates on which the magnet strips lie are apertured to make the plates acoustically transparent. Conductors are grouped in runs on the diaphragm opposite alternate pairs of magnet strips. The magnet strips have magnetic poles of opposite polarity at their front faces.

U.S. Pat. No. 6,104,825 teaches a planar magnetic transducer that includes a clamping frame, a diaphragm with an electrical conductor and a plurality of magnetic bars. The diaphragm is secured to the frame and has an active surface area under tension spaced inwardly of the frame. The electrical conductor is disposed on the active surface area of the diaphragm. The magnetic bars are mounted so that they are spaced from said diaphragm.

The inventor hereby incorporates the above patents by reference.

SUMMARY OF THE INVENTION

The present invention is directed to a transducer. The transducer includes a diaphragm with areas of multiple electrical conductors, two rows of magnetic bars, two metal plates and a clamping frame. The diaphragm is clamped in the clamping frame and is positioned between the two rows of magnetic bars. Each row of magnetic plates is in close proximity to the clamped diaphragm. Each metal plate has holes. The holes correspond to spacing areas between the magnetic bars and acoustically connect the diaphragm to outside media. The magnetic bars are sequentially located on the metal plates with spacing between the magnetic bars. The diaphragm is secured to the clamping frame and has an active surface area under tension spaced inwardly of the clamping frame.

In a first aspect of the invention there are no side magnetic bars at the ends of each of the row. Absorbing strips are used in place of the absent magnetic bars filling the space between the side magnetic bars and the clamping frame.

In a second aspect of the invention the planar magnetic transducer can be made at a reduced cost while retaining the low frequency extension and most of the efficiency. Efficiency is reduced in some points across the reproduced band but not to an extent that is proportional to the magnetic field reduction.

In a third aspect of the invention the planar magnetic transducer provides wider dispersion in horizontal plane.

In a fourth aspect of the invention the planar magnetic transducer provides smoother frequency response and reduced parasitic noise and buzz due to introducing resistive acoustic loading at the periphery of the diaphragm.

Other aspects and many of the attendant advantages will be more readily appreciated as the same becomes better understood by reference to the following detailed description and considered in connection with the accompanying drawing in which like reference symbols designate like parts throughout the figures.

The features of the present invention which are believed to be novel are set forth with particularity in the appended claims.

DESCRIPTION OF THE DRAWINGS

FIG. 1 is a schematic drawing of a planar magnetic transducer of the prior art.

FIG. 2 is a schematic drawing of the driving force of the diaphragm of the planar magnetic transducer of FIG. 1.

FIG. 3 is a schematic drawing of the flux density in the plane of the diaphragm of the planar magnetic transducer of FIG. 1.

FIG. 4 is a schematic drawing of the polar dispersion in the horizontal plane of the planar magnetic transducer of FIG. 1 at 15,000 Hertz.

FIG. 5 is a schematic drawing of a planar magnetic transducer according to the present invention.

FIG. 6 is a schematic drawing of the driving force of the diaphragm of the planar magnetic transducer of FIG. 5.

FIG. 7 is a schematic drawing of the flux density in the plane of the diaphragm of the planar magnetic transducer of FIG. 5.

FIG. 8 is a schematic drawing of the polar dispersion in the horizontal plane of the planar magnetic transducer of FIG. 5 at 15,000 Hertz.

DESCRIPTION OF THE PREFERRED EMBODIMENT

Referring to FIG. 1 a planar panel transducer 10 includes a diaphragm 11 with areas of multiple electrical conductors 12, two rows of magnetic bars 13, two metal plates 14 and a clamping frame 15. The diaphragm 11 is clamped in the clamping frame 15 and is positioned between the two rows of magnetic bars 13. The magnetic bars 13 are sequentially located on metal plates 14 with spacing between the magnetic bars 13. The metal plates 14 have holes 16 which correspond to spacing areas between magnetic bars 13 and which acoustically connect the diaphragm 11 to outside media. The magnetic bars 13 are magnetized in a direction perpendicular to the metal plates 14. A magnetic bar 13 from one side of a diaphragm and the opposite magnetic bar 13 from the other side of the diaphragm 11 are facing the diaphragm 11 and each other with the same magnetic poles either S or N. Each adjacent magnetic bar 13 that is located on the same side of the diaphragm 11 has the opposite direction of magnetization, thus each following magnetic bar 13 faces the diaphragm with the opposite magnetic pole, following the sequence N, S, N, S, N and so on. Magnetic field created by the magnetic bar arrangement has the maximum inductance vector B in a plane of the diaphragm 11 across the lines of the multiple electrical conductors 12. When electrical signal is applied to the diaphragm 11, the current that flows through multiple electrical conductors 12 interacts with the magnetic field and resulting electromotive force makes the diaphragm 11 vibrate in the direction perpendicular its plane. Vibrating, the diaphragm 11 radiates sound waves that emanate through the spacing between the magnetic bars 13 and the holes 16 in the metal plates 14 in both directions from the diaphragm 11. Different acoustical loading conditions may be applied to the design such as using a metal plate without holes or attaching an enclosure form one side of a transducer.

The use of rear earth magnetic materials, such as Neodymium, which has become the magnetic material of choice in recent years, allows significant reduction of size and efficiency improvement of such design. As a result such design can provide very high quality sound with minimal front to back space required, thus allowing to build "flat" panel planar loudspeakers for many critical applications.

However there are certain issues and limitations inherent for this design. In order to extend effective frequency range of such design in a region of lower frequencies, a transducer has to have significant radiating area. Accounting for certain length and height restrictions this leads to necessity of increasing the width of the transducer using many rows of magnets. As a result of increased width, horizontal dispersion of such design suffers and transducer starts "beaming" at higher frequencies exhibiting narrow dispersion and consequently poor sound quality. Another problem that arises with large diaphragm area is presence of significant modal vibrations due to insufficient mechanical losses in diaphragm substrate, usually plastic film. These pronounced vibrations at diaphragm resonance frequencies lead to response irregularities and parasitic noises (buzzing) at lower frequencies that are very often encountered in planar transducers.

Referring to FIG. 2 in conjunction with FIG. 3 and FIG. 4 driving force of the conductor 12 of the planar magnetic transducer 10 can be seen. The flux density in the plane of the conductor 12 of the planar magnetic transducer 10 and the polar dispersion in the horizontal place of the planar magnetic transducer 10 at 15,000 Hertz can also be seen.

Referring to FIG. 5 a planar transducer 110 includes a diaphragm 111 with areas of multiple electrical conductors 112, two rows of magnetic bars 113, two metal plates 114 and a clamping frame 115. The diaphragm 111 is clamped in the clamping frame 115 and is positioned between the two rows of magnetic bars 113. The magnetic bars 113 are sequentially located on the metal plates 114 with spacing between the magnets. The metal plates 114 have holes 116 which correspond to spacing areas between the magnetic bars 113 and which acoustically connect the diaphragm 111 to outside media. The magnetic bars 113 are magnetized in a direction perpendicular to the metal plates 114. A magnetic bar 113 from one side of the diaphragm 111 and the opposite magnetic bar 113 from the other side of the diaphragm 111 are facing the diaphragm 111 and each other with the same magnetic poles either S or N. Each adjacent magnetic bar 113 that is located on the same side of the diaphragm 111 has the opposite direction of magnetization, thus each following magnetic bar 113 faces the diaphragm 111 with the opposite magnetic pole, following the sequence N, S, N, S, N and so on. Magnetic field created by the magnetic bar 113 arrangement has the maximum inductance vector B in a plane of the diaphragm 111 across the lines of the multiple electrical conductors 112. When electrical signal is applied to the diaphragm 111, the current that flows through multiple electrical conductors 112 interacts with the magnetic field and resulting electromotive force makes the diaphragm 111 vibrate in the direction perpendicular its plane. Vibrating, the diaphragm 111 radiates sound waves that emanate through the spacing between the magnetic bars 113 and the holes 116 in the metal plates 114 in both directions from the diaphragm 111. The width of transducer 110 is retained in order to provide low resonance frequency and sufficient vibrating area and thus extended low frequency response. The side magnetic bars 113 are eliminated and replaced with absorbing strips 117 filling the whole area between remaining side magnetic bars 113 and the clamping frame 114.

These absorbing strips do not touch the diaphragm 111 and they do not clamp it. The absorbing strips 117 are made from acoustically semitransparent absorptive material, such as felt, and are placed close to the diaphragm 111, filling the whole area between the diaphragm 111 and the metal plates 114.

As is known from mechanics, the clamped diaphragm 111 does not vibrate as a piston. At lower frequencies the amplitude of vibrations are much larger in the middle of the diaphragm 111 than at the periphery near clamped edges. Consequently a certain force applied to the diaphragm 111 will produce larger vibrations if it is applied in the middle rather than closer to clamped edges.

Referring to FIG. 6 in conjunction with FIG. 7 and FIG. 8 driving force of the conductor 112 of the planar magnetic transducer 110 can be seen. The flux density in the plane of the conductor 112 of the planar magnetic transducer 10 and the polar dispersion in the horizontal place of the planar magnetic transducer 10 at 15,000 Hertz can also be seen.

Referring to FIG. 6 in conjunction with FIG. 7 reducing the amount of magnet-bars 113 reduces the magnetic flux density at the sides and force applied to the multiple electrical conductors 112 that are closer to the clamped edges of the diaphragm edges 111. However, since efficiency of driving force applied at the sides is much lower than applied closer to the middle of the diaphragm 111, the overall reduction of transducer sensitivity will be less than proportion of total magnetic energy reduction. Thus it is possible largely retaining sensitivity of the transducer 110 to significantly reduce its cost by placing less magnet-bars 113 closer to the middle of the diaphragm.

Referring to FIG. 8 there in an improved dispersion of the transducer 111 due to replacing magnet-bars 113 with the absorbing strips 117 which are positioned in close proximity to the diaphragm 111. At lower frequencies the absorption of the absorbing strips 117 is relatively low, therefore the sound radiated at these frequencies from the areas of the diaphragm 111 covered with the strips 117 will be passing through. As the frequency increases the absorption of the strips 117 also increases and radiation from covered periphery areas is progressively attenuated. This effect greatly contributes to a widening of transducer dispersion and eliminates side lobs in polar dispersion plot. Ultimately at very high frequencies, all radiation from periphery region that is close to the clamped edges will be attenuated, thus reducing radiating area width only to those holes in the middle which are not covered with absorptive material. The progressive reduction of radiating area width results in significant widening of the dispersion in horizontal plane and eliminates the secondary side lobes. Wider dispersion and absence of side lobes greatly improve sound quality in wider space area delivering better balance and larger stereo "sweet spot".

Another benefit of using absorptive strips at the sides of the diaphragm is additional acoustic loading of the periphery region of the diaphragm 111. This loading is created by very close proximity that is usually less than 1 millimeter of the absorbing strips 117. This resistive loading does not reduce effective diaphragm size and it does not increase mass of the diaphragm 111 as do other dampening techniques that rely on coating or clamping periphery area with absorptive materials. The proposed dampening represents resistive acoustic loading leading to "contact free dampening" of periphery of the diaphragm 111. The result of this dampening is a reduction of reflection of vibrations back from the clamped edges and thus smoother frequency response of the transducer and much less buzz.

While this invention has been particularly shown and described with references to preferred embodiments thereof. It will be understood by those skilled in the art that various changes in form and details may be made therein without departing from the spirit and scope of the invention as defined by the appended claims It should be noted that the sketches are not drawn to scale and that distances of and between the figures are not to be considered significant.

Accordingly it is intended that the foregoing disclosure and showing made in the drawing shall be considered only as an illustration of the principle of the present invention.

What is claimed is:

1. A planar magnetic transducer comprising:

a. a diaphragm with areas of multiple electrical conductors;

b. two rows of magnetic bars with there being no side magnetic bars at the ends of each of said rows of magnetic bars in close proximity to the clamped edge of said diaphragm;

c. two metal plates each of which has holes which correspond to spacing areas between said magnet-bars and which acoustically connect said diaphragm to outside media;

d. a clamping frame wherein said diaphragm is clamped in said clamping frame and is positioned between said two rows of magnetic bars and wherein said magnetic bars are sequentially located on said metal plates with spacing between the said magnet bars; and e. absorbing strips in place of the absent magnetic bars thereby filling the whole area between the remaining magnetic bars and said clamping frame on said diaphragm.

* * * * *